US005267615A

United States Patent [19]

Christiansen et al.

[11] Patent Number: 5,267,615

[45] Date of Patent: Dec. 7, 1993

[54] SEQUENTIAL FLUID INJECTION PROCESS FOR OIL RECOVERY FROM A GAS CAP

[76] Inventors: Richard L. Christiansen, 7954 S. Pennsylvania Dr., Littleton, Colo. 80122; Sidney R. Smith, 1464 S. Vancouver Ct., Lakewood, Colo. 80228

[21] Appl. No.: 891,324

[22] Filed: May 29, 1992

[51] Int. Cl.[5] ..... E21B 43/18

[52] U.S. Cl. ..... 166/273; 166/268; 166/274

[58] Field of Search ..... 166/268, 273, 274, 272, 166/306

[56] References Cited

U.S. PATENT DOCUMENTS

| | | | |
|---|---|---|---|
| 2,754,911 | 7/1956 | Spearow | 166/268 |
| 3,472,320 | 1/1965 | Dyes | 166/273 |
| 3,480,081 | 11/1969 | Felsenthal et al. | 166/272 X |
| 3,529,668 | 9/1970 | Bernard | 166/273 |
| 3,779,315 | 8/1972 | Boneau | 166/268 |
| 3,788,398 | 12/1971 | Shephard | 166/269 |
| 3,882,940 | 5/1975 | Carlin | 166/273 |
| 4,040,483 | 8/1977 | Offeringa | 166/272 |
| 4,042,029 | 8/1977 | Offeringa | 166/272 |
| 4,393,936 | 7/1983 | Josendal | 166/274 X |
| 4,427,067 | 8/1982 | Stone | 166/274 |
| 4,846,276 | 9/1988 | Haines | 166/273 |
| 4,848,466 | 7/1989 | Lin | 166/273 |
| 4,856,589 | 8/1989 | Kuhlman et al. | 166/273 |
| 5,025,863 | 6/1990 | Haines et al. | 166/305.1 |

FOREIGN PATENT DOCUMENTS

| | | | |
|---|---|---|---|
| 1022064 | 12/1977 | Canada | 166/272 |

*Primary Examiner*—George A. Suchfield

[57] ABSTRACT

A process is provided for recovering oil from a gas cap in a subterranean oil-bearing formation by injecting a water-alternating-gas cycle into the gas cap via an injection well in fluid communication therewith. The cycle includes a slug of an aqueous fluid and a slug of a non-aqueous gas. The aqueous fluid slug is substantially smaller in volume than the non-aqueous gas slug, the aqueous fluid slug being only of sufficient volume to substantially increase the water saturation of the gas cap without substantially increasing the gas saturation of the gas cap. The two slugs are injected into the gas cap sequentially, thereby displacing at least a portion of the oil in place from the gas cap into a production well. Any number of cycles are performed in sequence until the process is terminated.

17 Claims, 5 Drawing Sheets

SEQUENTIAL FLUID INJECTION PROCESS FOR OIL RECOVERY FROM A GAS CAP

FIELD OF THE INVENTION

The present invention relates to a process for the recovery of hydrocarbons from a subterranean hydrocarbon-bearing formation. More particularly, the invention relates to a process for recovering oil from a gas cap in a subterranean oil-bearing formation by sequentially injecting cycles of water and gas into the formation at a low water to gas ratio.

BACKGROUND OF THE INVENTION

The recovery of residual oil remaining in place in a gas cap following primary oil recovery is problematic because capillary forces usually trap a large fraction of the residual oil in the gas cap pores. Water-alternating-gas (WAG) floods have commonly been used in place of conventional water or gas floods for displacing residual immobile oil from formations having already undergone primary recovery. It is believed that the gas flood renders the oil in place more mobile so that it may be readily swept from the formation by a subsequent waterflood. Therefore, it has been suggested to employ a WAG flood in a gas cap to more effectively recover residual oil therefrom. Unfortunately, WAG floods have not proven as effective when applied to a gravity drainage mechanism, such as found in most gas caps, than when applied to a horizontal sweep mechanism.

In a conventional WAG process, as taught for example in U.S. Pat. No. 4,846,276 to Haines, the water is injected into the formation in relatively large volumes approximating the volume of injected gas. Both the injected water and injected gas are designed to horizontally sweep the formation and displace fluids residing therein under favorable mobility conditions. However, when the flood vertically sweeps the formation, as in the case of a gas cap, the water simply drops through the formation under the force of gravity bypassing the oil-containing pores. Even where a preceding gas has increased the mobility of the oil, contacting of the oil with subsequently injected water is generally very poor in a gas cap.

U.S. Pat. No. 3,788,398 to Shephard recognizes the shortcomings of a conventional WAG flood in a gas cap and attempts to remedy the problem by injecting a gas upward from beneath the waterflood to improve horizontal distribution of the water across a gas cap that is undersaturated as to water. Shephard relies on the waterflood to enter the gas cap and displace the gas therefrom. The displaced gas then carries mobile oil with it to the production well.

It has been found, however, that the method of Shephard is ineffective where the gas cap is water saturated. A water saturated gas cap cannot accommodate the quantities of water sufficient to adequately sweep the gas cap in the manner required by Shephard. Thus, the injected water simply fingers through the gas cap in the same manner as a conventional WAG flood.

Accordingly, it is an object of the present invention to provide a process for effectively recovering residual oil from a gas cap following primary recovery. It is another object of the present invention to effectively recover residual oil from a gas cap that is water saturated, and particularly wherein the level of water saturation is relatively low. It is further an object of the present invention to provide a process for sequentially flooding a gas cap with cycles of water and gas, wherein the water portion of each cycle effectively contacts the residual oil trapped by capillary pressure in the gas cap pores.

SUMMARY OF THE INVENTION

The present invention is a sequential fluid injection process for recovering oil from a gas cap in a subterranean hydrocarbon-bearing formation. The process is particularly applicable to the recovery of oil remaining in the pores of a gas cap located within a formation that has undergone primary oil recovery. The process is further applicable to the recovery of oil from a gas cap that exhibits fracturing and relatively low connate water saturation.

The process is initiated by injecting a water-alternating-gas (WAG) cycle into the gas cap via an injection well in fluid communication therewith. The WAG cycle comprises a slug of an aqueous fluid and a slug of a non-aqueous gas. The two slugs are injected into the gas cap sequentially, thereby displacing at least a portion of the oil in place from the gas cap into a production well that is likewise in fluid communication with the gas cap. The displaced oil is drawn through the production well to the surface where it is recovered by the operator.

Any number of WAG cycles are performed in sequence until the operator elects to terminate the process. The process is preferably terminated when oil recovery substantially ceases, as demonstrated by one or more consecutive cycles resulting in uneconomic oil recovery.

In distinction to WAG cycles taught by the prior art, the aqueous fluid slug of the present WAG cycle is predetermined to be substantially smaller in volume than the non-aqueous gas slug. The aqueous fluid slug has a maximum volume equivalent to only a fraction of the gas cap pore volume. Additionally, the volume of the aqueous fluid slug is at least one order of magnitude less than the volume of the non-aqueous gas slug. Thus, relatively small volumes of aqueous fluid are injected into the gas cap in accordance with the present invention to facilitate displacement of oil therefrom.

The process of this invention will be further understood from the accompanying drawings, taken in conjunction with the accompanying description, in which similar reference characters refer to similar parts.

DESCRIPTION OF PREFERRED EMBODIMENTS

Figure 1:
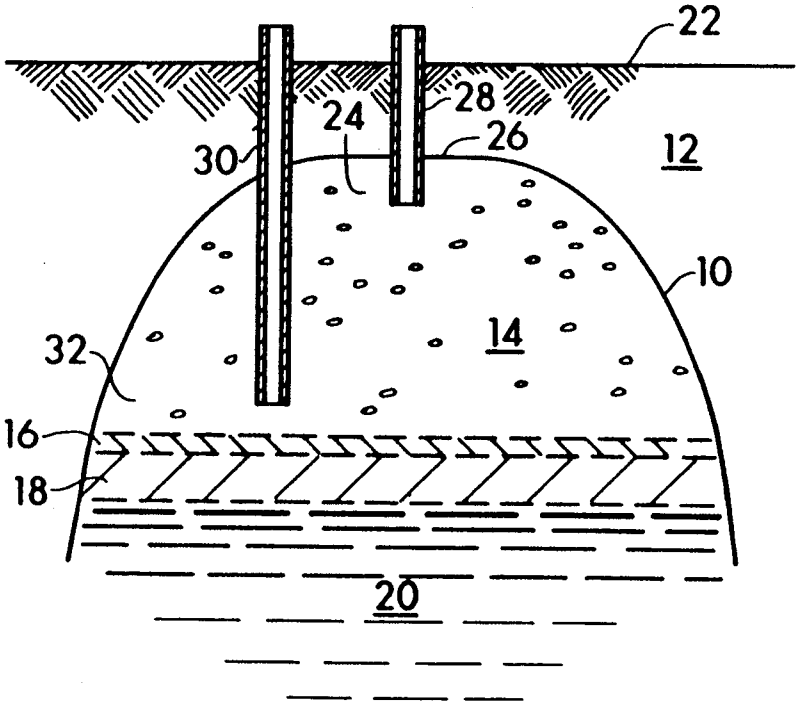
FIG. 1 is schematic view of a subterranean hydrocarbon-bearing formation having a gas cap penetrated by an injection well and a production well.

A representative subterranean environment in which the process of the present invention can be practiced is described with reference to FIG. 1. A subterranean formation 10 is shown in FIG. 1 having a plurality of vertically-disposed fluid-permeable zones in fluid communication with one another. Surrounding formation 10 is a region 12 of substantially fluid impermeable rock. Each zone of formation 10 is identified by the primary fluid residing therein. The uppermost zone 14 is a dome-shaped structure termed the gas zone or gas cap.

The gas cap 14 is formed from a permeable material having a plurality of pores defining a pore volume. The primary fluid contained within the gas cap 14 is a multi-component gas termed a "gas cap gas." A typical gas cap gas is relatively immiscible and comprises, in the majority, methane and ethane, and further comprises a smaller fraction of carbon dioxide and nitrogen. Gas cap gases, however, are not limited exclusively to such compositions. In certain formations, a gas cap can contain substantial amounts of nitrogen.

In addition to gas cap gas, residual amounts of oil and connate water are contained within the gas cap 14, and specifically within the pores thereof. Residual oil is defined herein as, for the most part, oil remaining in place within the pores of the gas cap 14 after the formation has undergone a primary oil recovery process to substantial economic completion. Economic completion is understood to be constrained by a reasonable period of time. For example, in a formation susceptible to a gravity drainage mechanism, oil can theoretically be recovered by primary means for a virtually indefinite period. However, a period of two hundred years or less would constitute a reasonable time constraint for economic completion when a primary recovery process is applied to a formation exhibiting gravity drainage.

Residual oil is in most cases held in the pores by capillary effects. Thus, the oil targeted for recovery by the process of the present invention is oil in place within the gas cap 14 that is not otherwise recoverable by conventional primary oil recovery processes. Such oil can typically occupy on the order of about 20% to about 60% of the gas cap pore volume.

The present process is particularly effective for the recovery of oil from gas caps that are water saturated and exhibit a relatively low degree of connate water saturation, i.e., from about 15% to 0%. Connate water is defined herein as formation brine that is substantially immobile under natural formation conditions. The present process has also been found to be particularly effective for the recovery of oil from gas caps that are water-wet, although the process may have utility in oil-wet environments as well.

Situated vertically beneath the gas cap 14 is an oil zone 16 containing oil that has drained downward by gravity from the gas cap 14, but has not previously been recovered. Insofar as formation 10 has already undergone primary oil recovery, the oil zone 16 may be small or negligible. Immediately beneath the oil zone 16 is a transitional zone 18 comprising a mixture of oil and water between an underlying aquifer 20 and the oil zone 16. Under some conditions the oil zone 16 may be entirely absent from the formation 10, in which case the transitional zone 18 is immediately beneath the gas cap 14 separating it from the aquifer 20.

Penetrating the gas cap 14 from the surface 22 and opening into the upper portion 24 of the gas cap 14 proximal the gas cap apex 26 is an injection well 28 enabling the injection of fluids into the upper portion 24 of the gas cap 14. In addition, a production well 30 spaced apart from the injection well 28 penetrates the gas cap 14 from the surface 22 and opens into the lower portion 32 of the gas cap 14, preferably adjacent to, but not penetrating, the oil zone 16 or transitional zone 18. The production well 30 enables the recovery of fluids from the lower portion 32 of the gas cap 14.

It is to be understood that the process of the present invention is not limited exclusively to practice within formations having gas caps as shown in FIG. 1, but has general utility for the recovery of oil from substantially any formation having a gas cap residing above a permeable liquid-containing zone. Such formations include those varying in depth from relatively shallow, e.g., 300 meters or less, to relatively deep formations, e.g., 4,000 meters or more, and being at pressures ranging from relatively high, e.g., 40,000 kPa or more, to relatively low, e.g., pressure depleted. The formation composition can be homogeneous or heterogeneous sandstone or carbonate and the oil in place can range in density from light to heavy oils. The present process has been found effective when practiced in fractured gas caps that exhibit a gravity drainage mechanism for fluid flow therein.

The process of the present invention is initiated by the injection of a specific fluid sequence into the gas cap 14 via injection well 28. However, as a preliminary step to injection of the specific fluid sequence described hereafter, an oil displacement gas may first be continuously injected into the gas cap 14 via injection well 28 to displace substantial quantities of remaining mobile oil from the gas cap 14 before initiating injection of the specific fluid sequence of the present invention. The preliminary oil displacement gas is preferably an immiscible gas, such as gas cap gas, methane or nitrogen. Injection of the preliminary oil displacement gas is terminated when oil recovery from the production well 30 substantially ceases, if not earlier.

The specific fluid sequence of the present process is termed a water-alternating-gas (WAG) cycle and comprises a first slug of an aqueous fluid and a second slug of a non-aqueous gas. The aqueous fluid of the first slug can be any available water, such as fresh water, sea water, or reservoir-produced brine, and can be injected into the gas cap 14 via the injection well 28 in either a liquid state or a gaseous state, i.e., steam. The injection of steam initially functions to lower the viscosity of the oil within the gas cap 14, but in most cases the steam rapidly condenses after entry into the gas cap 14, thereby rendering the injection of steam indistinguishable from the injection of a liquid once the aqueous fluid is in place within the gas cap 14.

The aqueous fluid of the first slug can be augmented with a performance enhancing additive. For example, a surfactant composition may be added to the aqueous fluid in a volumetric concentration on the order of about 1% to alter the wettability of the gas cap 14. Surfactants capable of wettability alteration include polyethoxylated alcohol and alcohol ethoxy sulfate. The surfactant can also enable foaming of the aqueous fluid which is injected into the gas cap 14. Incorporation of a foam-forming surfactant into an aqueous fluid is particularly applicable where the aqueous fluid is to be injected in accordance with the process of the present invention into a fractured subterranean formation. A gas, for example, a nonaqueous gas similar to that used in the second slug, may be incorporated into the aqueous fluid containing a foam-forming surfactant to form a foam at the surface or may be injected simultaneously with the aqueous fluid via injection well 28 so as to form in the well and/or gas cap. Alternatively, a foam may be formed in injection well 28 and/or gas cap 14 by sequentially injecting the aqueous fluid containing a foam-forming surfactant and the second slug of a nonaqueous gas into gas cap 14 via injection well 28. By injecting a foam into and/or forming a foam within the gas cap 14, the relatively high viscosity of the foam will function to transport the foam a distance from well 28 which is greater than that which can be obtained by injection of the aqueous fluid alone. Once the foam breaks within fractures in the gas cap, the aqueous fluid will then permeate downwardly by gravity through the gas cap and imbibe into the surrounding rock thereby displacing oil. Accordingly, a greater radial distribution of aqueous fluid within a gas cap may be obtained by means of a foam, particularly where the gas cap is fractured.

The first slug has a finite predetermined volume which is defined relative to the pore volume of the gas cap and relative to the volume of the second slug of nonaqueous gas. Thus, a predetermined volume of the aqueous fluid is selected within a range extending from about 50% of the gas cap pore volume to less than about 0.01% thereof. The preferred range is between about 5% and about 0.05% of the gas cap pore volume, and most preferably between about 2% and about 0.1% of the gas cap pore volume. The predetermined volume of the aqueous fluid is further selected to be at least one order of magnitude less than the volume of the nonaqueous gas at the reservoir operating conditions. The volumetric ratio of aqueous fluid to nonaqueous gas is selected to be relatively low, i.e., within a range between about 1:1000 and 1:10, preferably between about 1:1000 and 1:100, more preferably between about 1:100 and about 1:10, and most preferably between about 1:50 and 1:20.

Once injection of a predetermined volume of aqueous fluid satisfying the above-recited criteria is completed, injection of the second slug into the gas cap 14 is initiated via the injection well 28. The preferred nonaqueous gas of the second slug is a gas cap gas because of its plentiful low-cost availability at the point of injection. Gas cap gases are generally immiscible in formation fluids and as such immiscible gases are preferred in the present process. Nevertheless, a number of nonaqueous miscible oil displacement gases, although less preferred, may also have utility in the present process, including enriched methane, ethane, carbon dioxide, enriched carbon dioxide, and mixtures thereof. Other preferred immiscible displacement gases having utility herein include methane, nitrogen, natural gas, and flue gas, and mixtures thereof.

Throughout the duration of the WAG cycle, the production well 30 is maintained operable and production of fluids therefrom is monitored. It is anticipated that most of the oil recovery from the production well 30 will occur simultaneous with, or immediately subsequent to, injection of the nonaqueous gas into the gas cap 14 because of the oil recovery mechanism ascribed below to the present process.

In any case, injection of the nonaqueous gas proceeds until a sufficient volume of the gas is injected through the injection well 28 into the gas cap 14 to satisfy the volumetric ratio of aqueous fluid to nonaqueous gas stated above. The volume of nonaqueous gas injected into the gas cap 14 may further be correlated to any one of a number of predetermined control parameters. Thus, for example, assuming the volumetric criteria are satisfied, injection of the nonaqueous gas may be terminated when oil production falls off by a predetermined percentage, oil production falls off to a predetermined level, the dissolved gas content of the oil in place achieves a predetermined value, or the composition of produced gas corresponds to the composition of the injected gas. Injection of the nonaqueous gas can be terminated either when oil production goes to zero or at an earlier stage of oil production depending upon, inter alia, the economics of nonaqueous gas injection.

When injection of the nonaqueous gas is terminated, the first WAG cycle is completed. The operator can terminate the overall process of the present invention at this point or can continue the process by the repetitive performance of any number of WAG cycles in continuous succession. The operator preferably terminates the overall process when the volume of oil recovered from the gas cap becomes economically inconsequential, i.e., one or more consecutive WAG cycles result in uneconomic recovery from the production well 30.

It is understood that although the terms first slug and second slug have been used above in association with the aqueous fluid and nonaqueous gas respectively, the aqueous fluid and nonaqueous gas may be injected into the gas cap 14 in either order. Where repeating cycles are injected into the gas cap 14, however, each succeeding fluid in the sequence is preferably dissimilar from the preceding or subsequent fluid. That is, an aqueous fluid is preferably followed and preceded by a nonaqueous gas or vice versa. Similarly, where the gas cap is preliminarily swept with an oil displacement gas, the first slug of the initial WAG cycle following the preliminary oil displacement gas preferably comprises an aqueous fluid.

It is further understood that, although the present process has been described above with reference to a single injection well and a single production well, a plurality of injection or production wells can be employed within the scope of the present invention so long as the limitations set forth above with respect to these wells are met.

The process of the present invention is not limited to any one specific mechanism. However, it is believed that the low ratio of aqueous fluid to nonaqueous gas in the WAG cycle of the present invention facilitates gravity drainage of oil from the gas cap under three-phase flow. The volume of water injected into the gas cap in accordance with the present invention is small enough so as not to trap oil in the gas cap. In particular, it is believed that when a small volume of water is placed in the upper portion of the gas cap, it permeates down into the gas cap under the force of gravity and imbibes into the surrounding rock thereby displacing oil. In so doing, the water saturation of the gas cap is increased while conversely decreasing the oil saturation of the gas cap. This occurs without substantially increasing the gas saturation or reducing the oil relative permeability of the gas cap. Thus, the relative permeability of the gas cap to oil is effectively increased.

The net effect of increasing water saturation without increasing gas saturation is that injected water enters the gas cap pores and selectively displaces the immobile oil residing therein. Consequently, the injected water becomes the immobile phase while the oil in place becomes the mobile phase of the gas cap. Mobile oil is thus displaced downwardly under the force of gravity toward the production well where the oil is recovered. When a nonaqueous gas is subsequently injected into the upper portion of the gas cap, the gas serves to maintain pressure within the gas cap and to disperse water throughout the gas cap.

This mechanism is believed distinguishable from that of conventional WAG processes insofar as the volume of aqueous fluid injected into the gas cap in the present process should not exceed a minimal volume sufficient to increase water saturation within the gas cap. If a relatively large volume of aqueous fluid is injected into the gas cap in the manner of a conventional WAG process, the beneficial effect of the present invention is lost because the injected fluid can undesirably decrease oil relative permeability while fingering through the gas cap without displacing any immobile oil from the gas cap pores, particularly if a fracture network is present.

Figure 2:
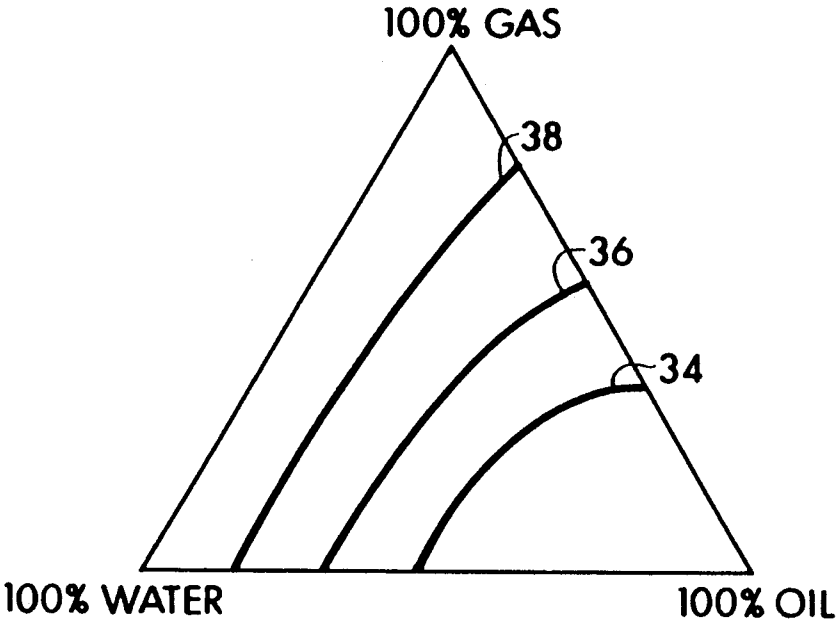
FIG. 2 is a ternary diagram of phase saturations for the three-phase system of the present invention wherein the curves depict oil isoperms.

The ternary diagram of FIG. 2 qualitatively depicts oil isoperms 34, 36, and 38 in the present three-phase system of water, gas, and oil. Oil isoperm 34 nearest the 100% oil saturation apex is strongly concave. It is apparent that when travelling along isoperm 34 the oil saturation of the formation can be reduced by increasing water saturation. Thus, for example, if isoperm 34 has an oil relative permeability value of 0.7, the following combinations of gas, water and oil saturations exist along isoperm 34 at this constant oil relative permeability value:

| $S_g$ | $S_w$ | $S_o$ |
|---|---|---|
| 37 | 0 | 63 |
| 35 | 5 | 60 |
| 32.5 | 12.5 | 55 |
| 28 | 22 | 50 |

If it is desired to reduce oil saturation by 13% when water saturation is 0%, water saturation is increased to 22% and gas saturation is decreased by 9%. Reduced oil saturation translates to increased incremental oil recovery according to the mechanism of the present invention.

The following examples demonstrate the practice and utility of the present invention, but are not to be construed as limiting the scope thereof.

EXAMPLE 1

A core of clean dry rock is prepared for the sequential injection process of the present invention by injecting about three pore volumes of separator oil at 3275 kPa into the core. The separator oil has a bubble point of about 510 kPa. The core has the following properties:

| | |
|---|---|
| Diameter (cm) | 8.81 |
| Length (cm) | 9.32 |
| Permeability (md) | 825 |
| Porosity (%) | 26.2 |
| Pore Volume (ml) | 149 |
| Connate Water (%) | 4.6 |

Several experimental runs are performed on the core, cleaning the core with solvents and returning the core to initial oil-bearing conditions after each run. Either two or three stages of fluids are sequentially injected into the core in each run according to the present process. The core has a vertical orientation with fluids being injected into the top of the core and produced from the bottom. In the first stage, a gas cap gas is injected into the core at 3 ml/hr until oil production ceases. The gas cap gas has the following composition:

| Component | Mole % |
|---|---|
| Carbon Dioxide | 5.0 |
| Hydrogen Sulfide | 1.0 |
| Nitrogen | 14.0 |
| Methane | 77.0 |
| Ethane | 2.0 |
| Propane | 1.0 |

In the second stage, the WAG cycle comprising a first brine slug and a second gas cap gas slug is injected into the core until incremental oil production is complete. In certain of the runs the second stage is followed by a third stage wherein a WAG cycle comprising a first brine/surfactant slug and a second gas cap gas slug is injected into the core again until incremental oil production is complete. The surfactant of the first slug is polyethoxylated alcohol at a concentration of 1% by volume in the brine. The brine is a 10,000 ppm sodium chloride solution.

The injection process is performed at a temperature of 28° C., a pore pressure of 3275 kPa, and an overburden pressure of 7205 kPa. The volume of fluids injected and recovered at different stages of the process are monitored and recorded below in Table 1.

TABLE 1

| Stage No. | Gas Inj'd (PV) | Brine Inj'd (PV) | Cum Oil Rec'd (% OOIP) | Inc Oil Rec'd (% OOIP) |
|---|---|---|---|---|
| | | Run No. 1: | | |
| 1 | 3.36 | — | 18.8 | — |
| 2 | 8.54 | 0.15 | 24.2 | 5.4 |
| 3 | — | — | — | — |
| | | Run No. 2: | | |
| 1 | 2.03 | — | 18.8 | — |
| 2 | 11.25 | 0.23 | 35.6 | 16.8 |
| 3 | — | — | — | — |
| | | Run No. 3: | | |
| 1 | 4.39 | — | 20.2 | — |
| 2 | — | — | — | — |
| 3 | 13.95 | 0.29 | 34.6 | 14.4 |

EXAMPLE 2

A second core of clean dry rock is prepared in the same manner as Example 1 for the sequential injection process of the present invention. The second core has the following properties:

| | |
|---|---|
| Diameter (cm) | 8.84 |
| Length (cm) | 8.76 |
| Permeability (md) | 241 |
| Porosity (%) | 22.7 |
| Pore Volume (ml) | 122 |
| Connate Water (%) | (not measured) |

The same experimental procedure as Example 1 is followed in Example 2 except that the temperature of run nos. 1 and 2 is adjusted to 55° C. The volume of fluids injected and recovered at different stages of the process are monitored and recorded below in Table 2.

TABLE 2

| Stage No. | Gas Inj'd (PV) | Brine Inj'd (PV) | Cum Oil Rec'd (% OOIP) | Inc Oil Rec'd (% OOIP) |
|---|---|---|---|---|
| | | Run No. 1: | | |
| 1 | 2.62 | — | 18.8 | — |
| 2 | 6.39 | 0.16 | 26.6 | 7.8 |
| 3 | 8.52 | 0.16 | 32.3* | 5.7 |
| | | Run No. 2: | | |
| 1 | 4.20 | — | 24.4 | — |
| 2 | — | — | — | — |
| 3 | 9.02 | 0.30 | 36.9 | 12.5 |

*Run terminated before reaching a plateau in cumulative oil production.

EXAMPLE 3

Figure 3:
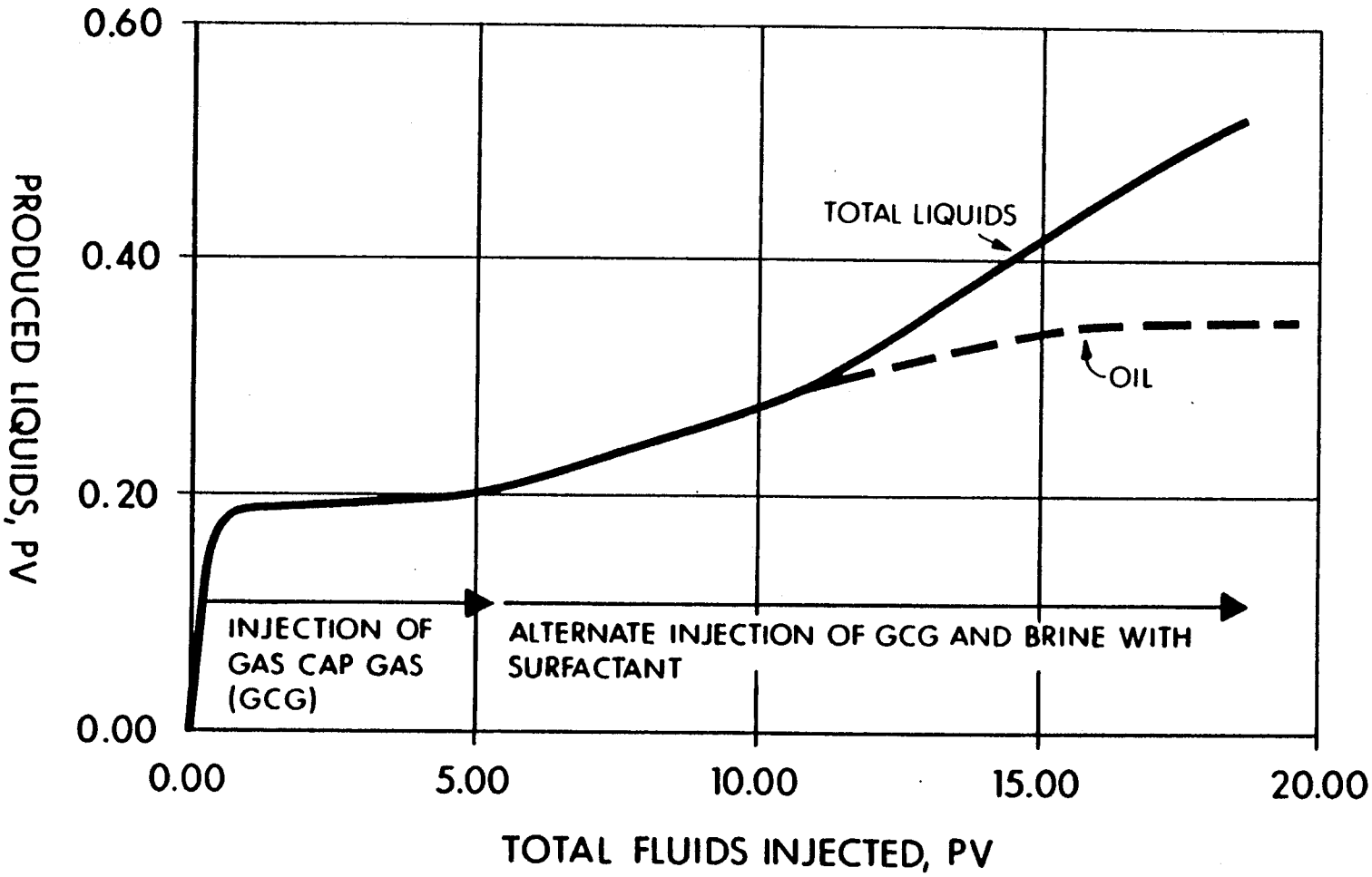
FIG. 3 is a liquid production history of the process of the present invention described in Example 3.
Figure 4:
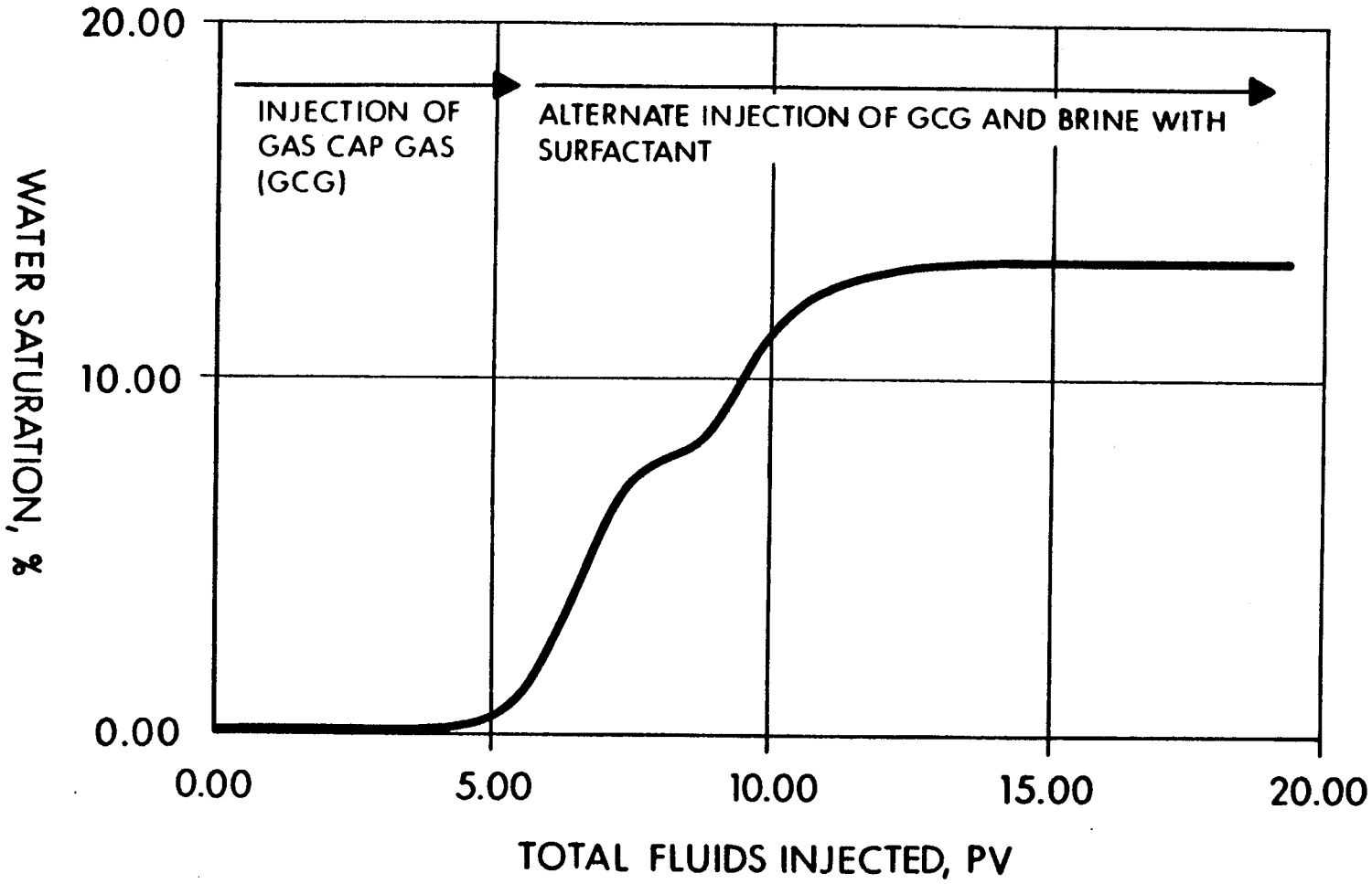
FIG. 4 is a liquid saturation history of the process of the present invention described in Example 3.

An experimental run is performed under the same initial conditions as Example 1. The liquid production and water saturation histories are shown graphically in FIGS. 3 and 4, respectively.

EXAMPLE 4

Figure 5:
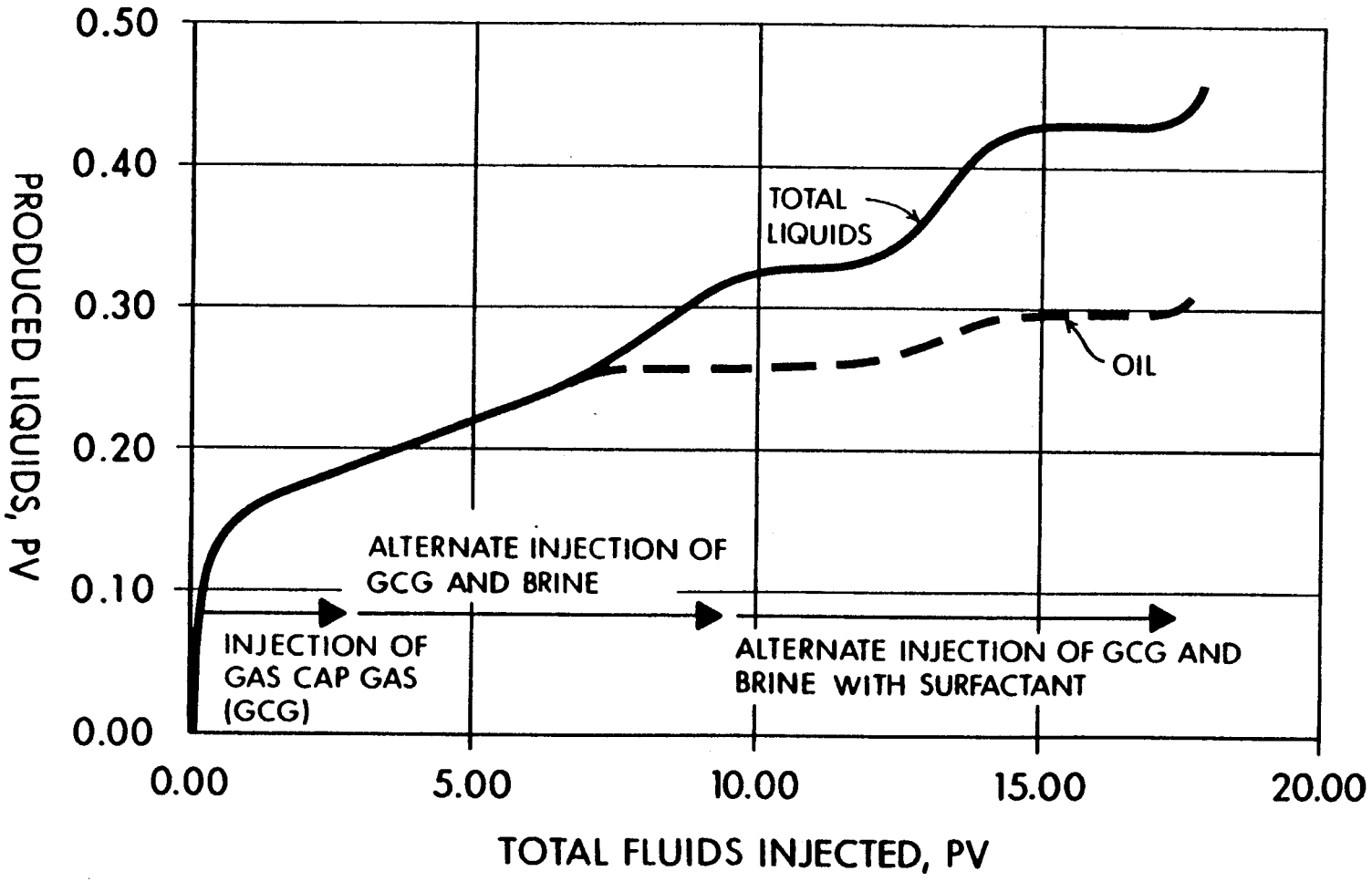
FIG. 5 is a liquid production history of the process of the present invention described in Example 4.
Figure 6:
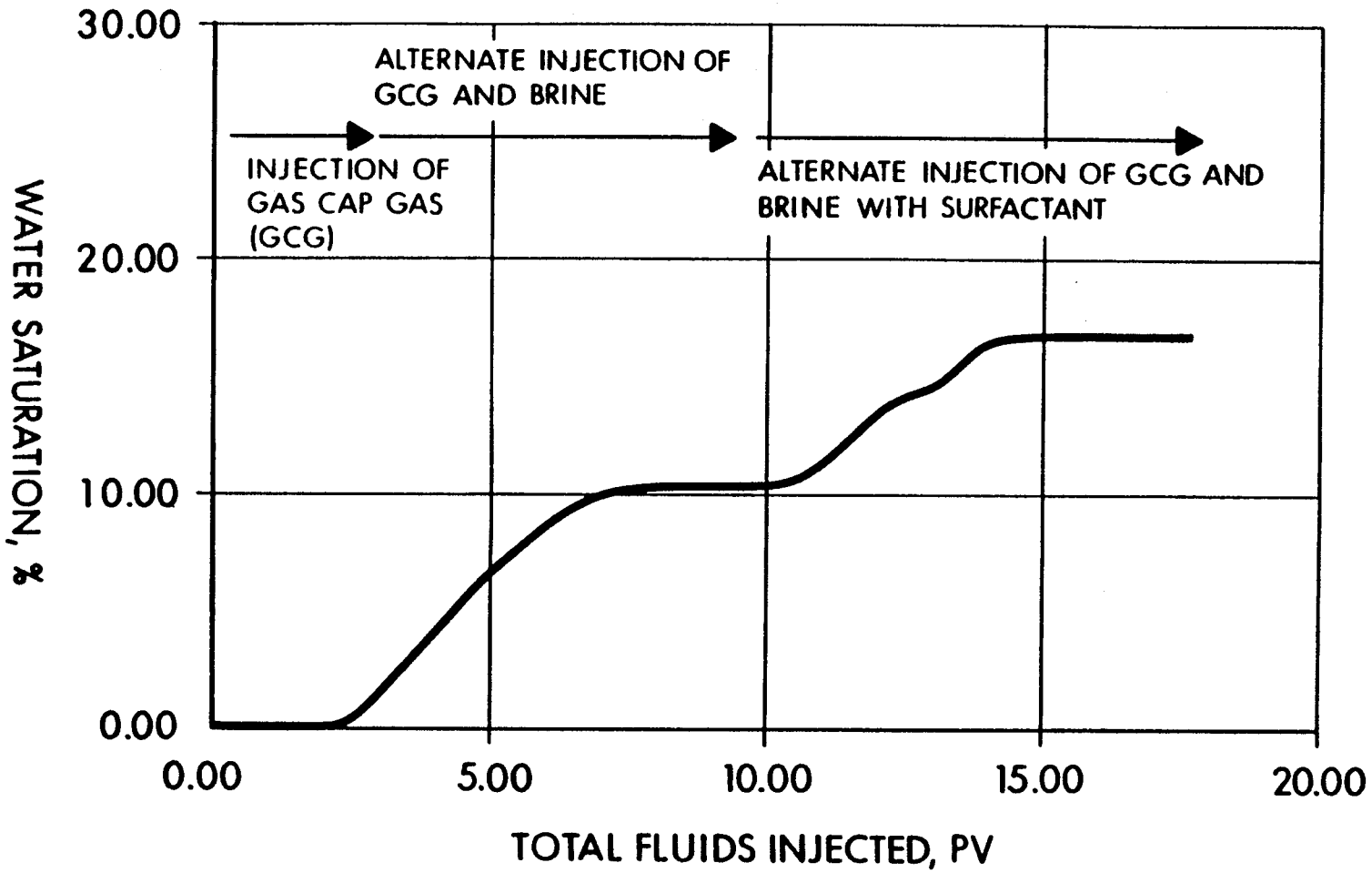
FIG. 6 is a liquid saturation history of the process of the present invention described in Example 4.

An experimental run is performed under the same initial conditions as Example 1. The liquid production and water saturation histories are shown graphically in FIGS. 5 and 6, respectively.

While the foregoing preferred embodiments of the invention have been described and shown, it is understood that alternatives and modifications, such as those suggested and others, may be made thereto and fall within the scope of the present invention.

We claim:

1. A process for recovering oil from a porous gas cap of a subterranean hydrocarbon-bearing formation comprising:

a) placing a volume of an oil-immiscible water in said gas cap to mobilize and displace heretofore substantially immobile oil residing therein;

b) injecting a volume of an oil-immiscible non-aqueous gas into said gas cap to drive said mobilized oil from said gas cap, wherein the ratio of said volume of said oil-immiscible water to said volume of said non-aqueous gas is no greater than about 1:10, and further wherein steps a and b constitute an injection cycle; and c) recovering said oil which is mobilized from said gas cap by said oil-immiscible water and driven from said gas cap by said oil-immiscible non-aqueous gas during said injection cycle while substantially retaining said oil-immiscible water in said gas cap.

2. A process for recovering oil as recited in claim 1 further comprising injecting a preliminary oil displacement gas into said gas cap and recovering oil therefrom prior to said injection cycle.

3. A process for recovering oil as recited in claim 2 wherein injection of said preliminary oil displacement gas is terminated when oil recovery from said gas cap prior to said injection cycle substantially ceases.

4. A process for recovering oil as recited in claim 1 wherein said injection cycle is repeated sequentially until at least once.

5. A process for recovering oil as recited in claim 1 wherein said injection cycle is repeated sequentially until oil recovery from said gas cap substantially ceases.

6. A process for recovering oil as recited in claim 1 wherein said injection cycle is initiated with step a.

7. A process for recovering oil as recited in claim 1 wherein said injection cycle is initiated with step b.

8. A process for recovering oil as recited in claim 1 wherein said water is a brine.

9. A process for recovering oil as recited in claim 1 wherein steam is injected into said gas cap and condensed therein to place said oil-immiscible water in said gas cap.

10. The process of claim 1 wherein said gas cap is fractured.

11. A process for recovering oil as recited in claim 1 wherein said non-aqueous gas is a gas cap gas.

12. A process for recovering oil as recited in claim 1 wherein said water is placed in said gas cap via an injection well having an outlet in an upper portion of said gas cap and said oil is recovered from said gas cap via a production well having an inlet in a lower portion of said gas cap.

13. A process for recovering oil as recited in claim 1 wherein said volume of said water is between about 5% and about 0.05% of the pore volume of said gas cap.

14. A process for recovering oil as recited in claim 1 wherein the ratio of said volume of said water to said volume of said non-aqueous gas is no greater than about 1:20.

15. A process for recovering oil from a porous gas cap of a subterranean hydrocarbon-bearing formation, said porous gas cap having initial water saturation, oil saturation and gas saturation values, said process comprising:

a) placing a volume of an oil-immiscible water in said gas cap sufficient to substantially increase said initial water saturation value and substantially decrease said initial oil saturation value, thereby mobilizing and displacing heretofore substantially immobile oil residing in said gas cap;

b) injecting a volume of an oil-immiscible non-aqueous gas into said gas cap to drive said mobilized oil from said gas cap, wherein said volume of said non-aqueous gas is substantially greater than said volume of said oil-immiscible water, and further wherein steps a and b constitute an injection cycle; and c) recovering said oil which is mobilized from said gas cap by said oil-immiscible water and driven from said gas cap by said oil-immiscible non-aqueous gas during said gas injection cycle while substantially retaining said oil-immiscible water in said gas cap.

16. A process for recovering oil as recited in claim 15 wherein said initial gas saturation does not substantially increase during steps a and b.

17. A process for recovering oil as recited in claim 15 wherein the ratio of said volume of said water to said volume of said non-aqueous gas is no greater than about 1:20.

* * * * *

UNITED STATES PATENT AND TRADEMARK OFFICE

CERTIFICATE OF CORRECTION

PATENT NO. : 5,267,615

DATED : December 7, 1993

INVENTOR(S) : Richard L. Christiansen

It is certified that error appears in the above-identified patent and that said Letters Patent is hereby corrected as shown below:

Col. 9, line 62: Delete "until".

Signed and Sealed this

Twenty-sixth Day of July, 1994

*Attest:*

*Attesting Officer*

BRUCE LEHMAN

*Commissioner of Patents and Trademarks*